US006022121A

United States Patent [19]

Lin

[11] Patent Number: 6,022,121

[45] Date of Patent: Feb. 8, 2000

[54] SCREWDRIVER PROVIDED WITH LIGHTING MEANS

[76] Inventor: Chang-Ming Lin, No. 331, Chang Chun St., Chiu Te Village, Wu Jih Hsiang, Taichung County, Taiwan

[21] Appl. No.: 09/332,422

[22] Filed: Jun. 14, 1999

[51] Int. Cl.[7] ..... B25B 23/18

[52] U.S. Cl. ..... 362/119; 362/120; 362/578

[58] Field of Search ..... 362/119, 120, 362/578

[56] References Cited

U.S. PATENT DOCUMENTS

| | | | |
|---|---|---|---|
| 4,283,757 | 8/1981 | Nalbandian et al. | 362/120 |
| 5,550,719 | 8/1996 | Kuo | 362/120 |
| 5,628,556 | 5/1997 | Hrabar et al. | 362/119 |
| 5,713,656 | 2/1998 | Lin | 362/120 |
| 5,803,584 | 9/1998 | Chung | 362/120 |
| 5,845,986 | 12/1998 | Breen | 362/119 |

*Primary Examiner*—Sandra O'Shea
*Assistant Examiner*—Ali Alavi
*Attorney, Agent, or Firm*—Harrison & Egbert

[57] ABSTRACT

A screwdriver including a handle, a tip holder, a bushing, two first guide wires, two second guide wires, two luminous elements, a coiled spring, a battery, a control switch, and an end cap. A circuit loop structure is formed of the first guide wires, the second guide wires, the coiled spring, the luminous elements, the battery, and the control switch. The circuit loop structure can be easily installed without being confined to one portion of the handle.

1 Claim, 5 Drawing Sheets

SCREWDRIVER PROVIDED WITH LIGHTING MEANS

FIELD OF THE INVENTION

The present invention relates generally to a screw driver, and more particularly to a screwdriver which is provided with a built-in lighting device.

BACKGROUND OF THE INVENTION

There are certain conventional screwdrivers which are provided with a lighting device. Such conventional screwdrivers are defective in design in that the circuit loop structure thereof is rather confined to one end of the handle, and that the handle must be provided with a special means for locating the battery set and the circuit loop structure.

SUMMARY OF THE INVENTION

The primary objective of the present invention is therefore to provide a screwdriver with an improved lighting means free from the drawbacks of the prior art screwdrivers described above.

The objective, features, functions, and advantages of the present invention will be readily understood upon a thoughtful deliberation of the following detailed description of a preferred embodiment of the present invention with reference to the accompanying drawings.

DETAILED DESCRIPTION OF THE EMBODIMENT

Figure 1:
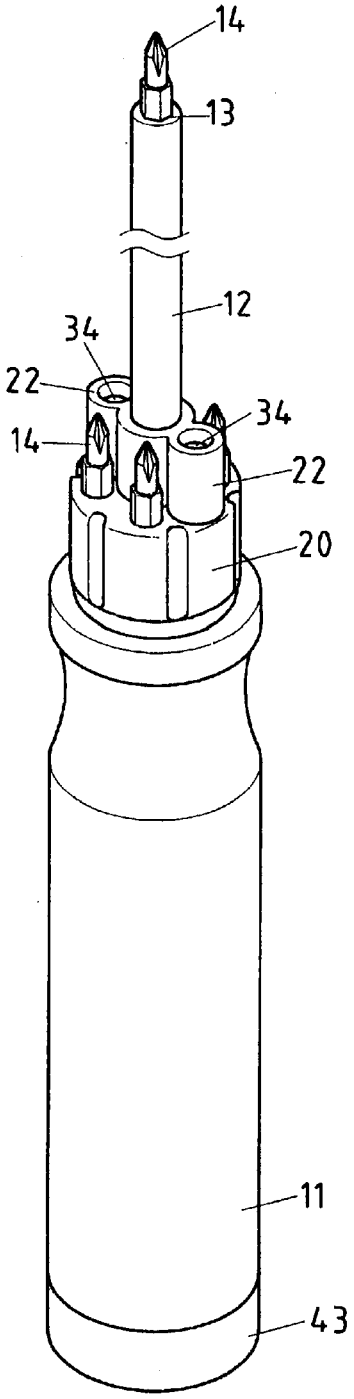
FIG. 1 shows a perspective view of the preferred embodiment of the present invention.
Figure 2:
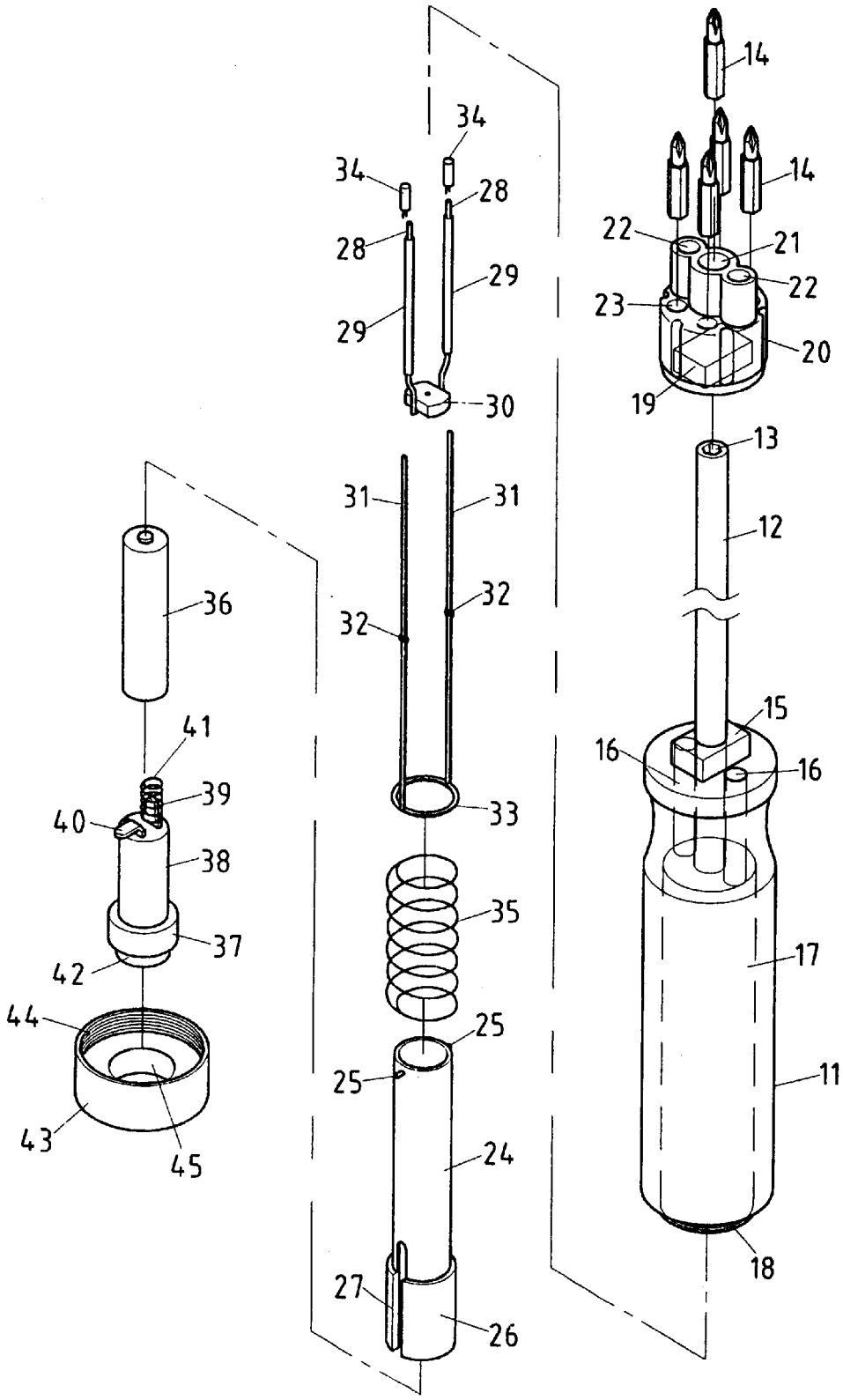
FIG. 2 shows an exploded view of the preferred embodiment of the present invention.

As shown in FIGS. 1 and 2, a screwdriver of the preferred embodiment of the present invention comprises the component parts which are described hereinafter.

A handle 11 is provided at the front end thereof with a shaft tube 12 which is in turn provided at the free end thereof with a fitting hole 13 for holding a tip 14. The handle 1 1 is further provided at the front end thereof with a block 15, and two through holes 16 in communication with a chamber 17 located in the interior of the handle 11. The handle 11 is further provided at the rear end thereof with a threaded portion 18.

A tip holder 20 is provided at the center thereof with an extension tube 21 having a through hole, and at the bottom end thereof with a slotted portion 19. The tip holder 20 is held by the shaft tube 12 such that the slotted portion 19 is fitted over the block 15, and that two hollow tubes 22 located side by side with the extension tube 21 are aligned with the two through holes 16 of the handle 11. The tip holder 20 is further provided with a plurality of fig holes 23 for holding tips 14 of various sizes.

A bushing 24 is provided in the outer wall of the front end thereof with two protrusions 25 corresponding in location to the two trough holes 16 of the handle 11.

Figure 3:
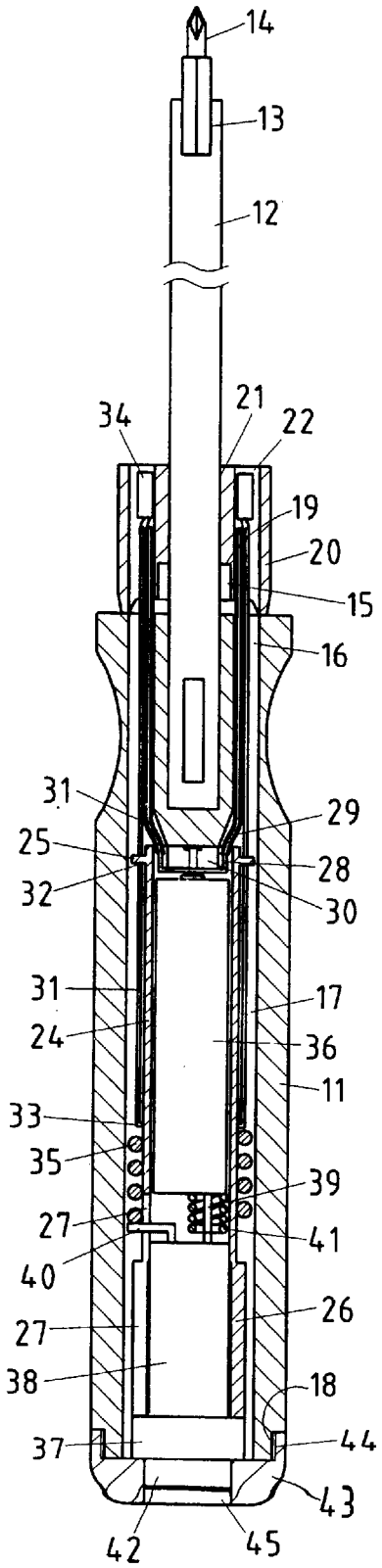
FIG. 3 shows a longitudinal sectional view of the preferred embodiment of the present invention in combination.
Figure 4:
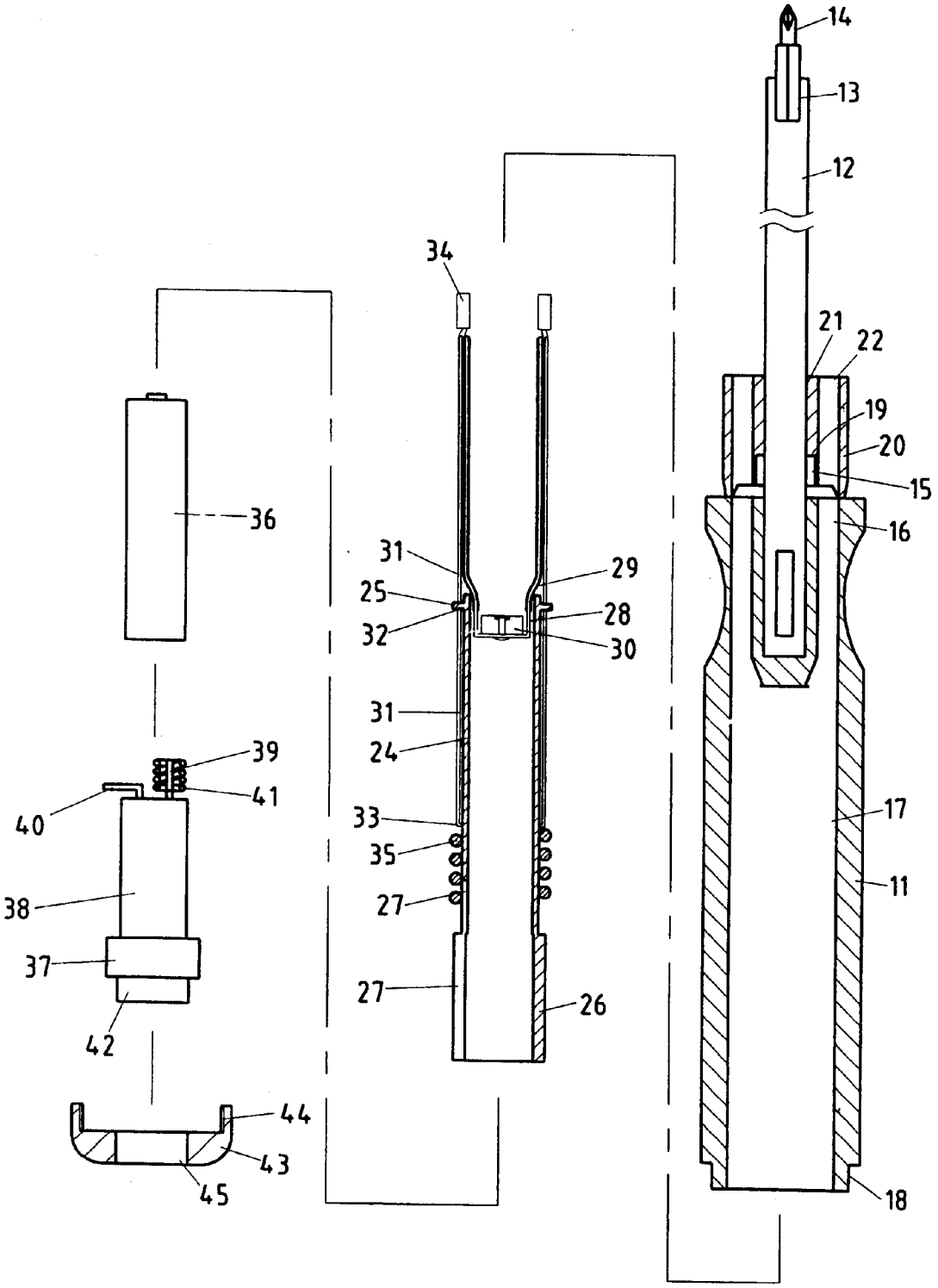
FIG. 4 shows a schematic view of the assembly of the preferred embodiment of the present invention.
Figure 5:
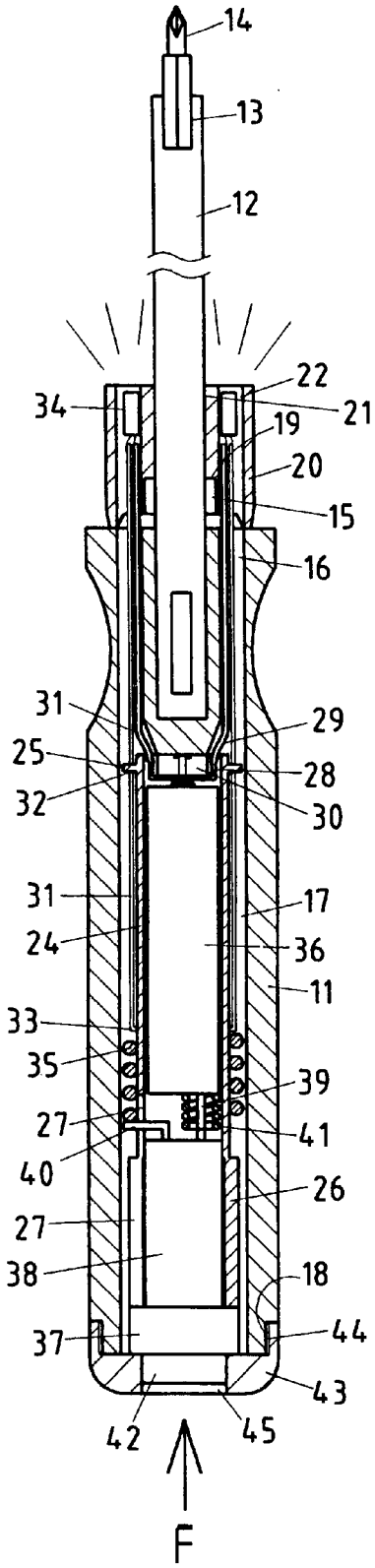
FIG. 5 shows a schematic view of the preferred embodiment of the present invention in operation.

Two first guide wires 28 are extended into the two hollow tubes 22 via the two through holes 16, as shown in FIG. 3. The first guide wires 28 are sheathed with an insulation layer 29 and are provided between two ends thereof with a press block 30 which is fitted into the front end of the bushing 24.

Two second guide wires 31 are provided at the midsegment thereof with a round hole 32 which is fitted over one of the two protrusions 25 of the bushing 24 such that the front ends of the two second guide wires 31 are extended into the two hollow tubes 22 via the two through holes 16, and that both rear ends of the second guide wires 31 are fastened with a fitting ring 33 which is dimensioned to fit over the bushing 24.

Two luminous elements 34 are provided respectively with a pin and are disposed in the two hollow tubes 22. The pin of one of the two luminous elements 34 is fastened with the end of one of the first guide wires 28, and with the end of one of the second guide wires 31.

A coiled spring 35 is fitted over the bushing 24 such that the coiled spring 35 is located between the fitting ring 33 and a sleeve 26 which is fitted over the rear end of the bushing 24 and is provided with a longitudinal slide slot 27.

A battery 36 is located in the bushing 24 such that one end of the battery 36 comes in contact with the press block 30.

A control switch 37 is provided with a tubular portion 38 which is disposed in the bushing 24 and is provided at one end thereof with an upright pin 39 and a horizontal pin 40. The upright pin 39 is provided with a spring 41 fitted thereover and is in contact with the other end of the battery 36. The horizontal pin 40 is jutted out of the longitudinal slide slot 27 to urge the coiled spring 35. The control switch 37 is provided at other end thereof with an actuating button 42.

An end cap 43 is provided with an inner threaded portion 44 engageable with the tbreaded portion 18 of the handle 11, and a center through hole 45 through which the actuating button 42 of the control switch 37 is jutted out.

The present invention is provided with a circuit loop structure which is formed of the first guide wires 28, the second guide wires 31, the coiled spring 35, the luminous elements 34, the battery 36, and the control switch 37. The coiled spring 35 and the fitting ring 33 are fitted over the bushing 24. The first guide wires 28 and the second guide wires 31 are arranged side by side. The press block 30 is disposed in the front end of the bushing 24 which is housed in the chamber 17 of the handle 11. The luminous elements 34 are located in the two hollow tubes 22 via the two through holes 16. The battery 36 and the control switch 37 are located in the bushing 24. The horizontal pin 40 of the control switch 37 is slidably confined to the longitudinal slide slot 27 such that the horizontal pin 40 presses against the coiled spring 35. The spring 41 of the upright pin 39 of the control switch 37 urges other end of the battery 36. The circuit loop structure of the present invention can be thus installed easily, thereby resulting in a reduction in the cost of making the screwdriver of the present invention.

I claim:

1. A screwdriver comprising:

a handle provided at one end thereof with a shaft tube which is provided with a fitting hole for holding a tip, said handle further provided at one end thereof with a block and two through holes in communication with a chamber located in an interior of said handle, said handle further provided at one end thereof with a threaded portion;

a tip holder provided at a center thereof with an extension tube having a through hole, and at a bottom end thereof with a slotted portion, said tip holder being held by said shaft tube such that said slotted portion is fitted over said block, and that said two hollow tubes located side by side with said extension tube are aligned with said two through holes of said handle, said tip holder further provided with a plurality of fitting holes for holding tips of various sizes;

a bushing provided in an outer wall of one end thereof with two protrusions corresponding in location to said two through holes of said handle;

two first guide wires extended into said two hollow tubes via said two through holes and sheathed with an insulation layer, said two first guide wires provided with a press block which is fastened with two ends of said two first guide wires and is fitted into one end of said bushing;

two second guide wires provided at a midsegment thereof with a round hole which is fitted over one of said two protrusions of said bushing such that the front ends of said two second guide wires are extended into the two hollow tubes via said two through holes, and that both rear ends of said second guide wires are fastened with a fitting ring which is fitted over said bushing;

two luminous elements provided with a pin respectively and disposed in said two hollow tubes whereby said pin of said two luminous elements is fastened with the end of one of the end of one of said first guide wires and the end of one of said second guide wires;

a coiled spring fitted over said bushing such that said coiled spring is located between said fitting ring and a sleeve which is fitted over other end of said bushing and is provided with a longitudinal slide slot;

a battery located in said bushing such that one end of said battery is in contact with said press block;

a control switch provided with a tubular portion which is disposed in said bushing and is provided at one end thereof with an upright pin and a horizontal pin whereby said upright pin is provided with a spring fitted thereover and is in contact with other end of said battery, and whereby said horizontal pin is jutted out of said longitudinal slide slot to urge said coiled spring, said control switch further provided at other end thereof with an actuating button; and an end cap provided therein with an inner threaded portion engaged with said threaded portion of said handle, and a center through hole through which said actuating button of said control switch is jutted out.

* * * * *